United States Patent [19]

Knorr et al.

[11] 3,982,582

[45] Sept. 28, 1976

[54] METHOD AND APPARATUS FOR CASTING METALS INTO A CONTINUOUS CASTING MOLD

[75] Inventors: Eberhard Knorr, Amberg; Thomas Ludwig Grünwald, Sulzbach-Rosenberg; Arno Oswald, Prinzing, Cham, all of Germany

[73] Assignee: Concast AG, Zurich, Switzerland

[22] Filed: Dec. 2, 1974

[21] Appl. No.: 528,721

[30] Foreign Application Priority Data

Dec. 8, 1973 Germany ..... 2361344

[52] U.S. Cl. ..... 164/136; 164/337; 222/293; 222/303; 266/236

[51] Int. Cl.[2] ..... B22D 11/10

[58] Field of Search ..... 164/82, 133, 136, 281, 164/337; 222/DIG. 1, DIG. 7, 591, 593, 603; 266/38, 236, 271

[56] References Cited

UNITED STATES PATENTS

| | | | |
|---|---|---|---|
| 3,581,948 | 6/1971 | Detalle | 164/281 X |
| 3,587,719 | 6/1971 | Schrewe et al. | 164/337 X |
| 3,730,401 | 5/1973 | Bode | 164/281 X |
| 3,743,007 | 7/1973 | Simons et al. | 164/281 |
| 3,743,139 | 7/1973 | Lyman | 266/38 X |
| 3,760,993 | 9/1973 | Meier | 222/DIG. 7 |
| 3,809,146 | 5/1974 | Andrzajak et al. | 164/82 X |

FOREIGN PATENTS OR APPLICATIONS

| | | | |
|---|---|---|---|
| 1,758,634 | 9/1970 | Germany | 164/136 |

*Primary Examiner*—Francis S. Husar
*Assistant Examiner*—Carl Rowold
*Attorney, Agent, or Firm*—Werner W. Kleeman

[57] ABSTRACT

A method and apparatus for casting of metals into a continuous casting mold wherein metal is cast out of a ladle into a tundish having at least one non-regulatable bottom discharge and into at least one mold by means of a pouring tube. After the start of the casting operation the casting jet emanating from the bottom discharge is controlled and, if desired, corrected to the desired casting jet formation and thereafter the pouring tube is brought into the casting position through the casting jet.

14 Claims, 2 Drawing Figures

METHOD AND APPARATUS FOR CASTING METALS INTO A CONTINUOUS CASTING MOLD

BACKGROUND OF THE INVENTION

The present invention relates to a new and improved method of, and apparatus for, casting metal into a continuous casting mold, the metallic melt being cast from a ladle into an intermediate vessel or tundish having at least one-regulatable bottom discharge or outlet and then into at least one mold by means of a pouring tube, and further pertains to apparatus for the performance of the aforesaid method.

During continuous casting of metallic salts, especially steel, the melt is cast into a tundish from which it arrives at the mold of the continuous casting installation. The tundish possesses at least one discharge or pouring opening from which there flows out the metallic melt. Generally however there are provided a number of discharge openings, and one function of the tundish resides in uniformly distributing the melt to the discharge openings. The discharge openings, preferably in the case of large continuous casting installations, for instance for fabricating steel slabs, possess devices in order to regulate the throughflow of the metallic melt, for example by means of stopper rods or slide closures, by means of which the outflow cross-section is appropriately changed.

During the continuous casting of smaller cross-sections, for instance when casting steel in billet casting machines there are used in contrast outlets with defined cross-section which changes as little as possible during the entire casting time. The throughflow in this case is determined by the ferrostatic height in the tundish which is maintained within narrow limits and by the cross-section of the bottom discharge opening.

For casting with regulatable bottom discharges or openings at the tundish the state-of-the-art has advanced a number of proposals for using a ceramic pouring tube which normally immerses into the metallic melt. The enclosure of the casting jet with such type pouring tube affords a series of advantages. There is prevented the entry of oxygen to the casting jet and there is also avoided danger to the operating personnel by virtue of metallic spray. A more significant advantage for the continuous casting operation, however, resides in the fact that the casting jet penetrates from the tundish into the bath level of the mold without entraining the slag on the metallic melt, i.e. without mixing the slag into the metallic bath of the mold. The use of a pouring tube first permits with the aid of casting agents, preferably flux powder, to work in the mold in order to attain the known advantages.

The described casting with regulatable bottom discharges or outlets at the tundish and the subsequently arranged pouring tubes has been found in practice, notwithstanding the aforementioned advantages, to only be operationally reliable and economical for large continuous casting installations. The discharge devices require a relatively extensive maintenance and control in order to open free of disturbance at the start of the casting operation and to render possible the regulation operation. The useful times of the regulatable bottom discharge normally amounts to no more than 2 to 3 melts. Consequently there is the necessity of having a considerable number of tundishes. In the case of continuous casting installations with smaller strand cross-sections, for instance billet installations for steel, the aforementioned discharges with stopper rods and slide regulation or control cannot be used because of the previously given reasons.

At continuous casting machines for billets and blooms there are normally used at the present time non-regulatable bottom discharges. These discharges require, especially at the start of the casting operation, oftentimes a brief burning with an oxygen lance in order to permit the casting jet to begin to run in an operationally reliable manner and to regulate the desired casting jet formation.

There is further known to the art a method for casting steel into a continuous casting mold in which the steel is cast out of a ladle into a tundish having a non-regulatable bottom discharge through a pouring tube into the mold. For opening a non-regulatable closure body introduced into the tundish, upon reaching the desired bath level in the tundish an appropriately shaped infeed pipe for oxygen is introduced through the pouring tube located in casting position up to the bottom discharge or outlet and by infeeding oxygen the bottom outlet is opened. What is disadvantageous with this technique is, on the one hand, the cumbersome application of the oxygen infeed and, on the other hand, there is no possibility for influencing the formation of the casting jet at the start of casting. Furthermore with this technique after the start of casting it is not possible to undertake any corrections, such as for instance the burning-off of deposits in and at the discharge nozzle.

SUMMARY OF THE INVENTION

Hence it is a primary object of the present invention to provide an improved method of and apparatus for casting of metals in a continuous casting mold in a manner not associated with the aforementioned drawbacks and limitations.

It is a further and more particular object of the invention to provide a method of and an apparatus which, on the one hand, in the case of tundishes with non-regulatable bottom discharges permits casting with a pouring tube and, on the other hand, allows for a rigid and operationally reliable starting of the casting operation as well as casting over a long period of time.

These objectives can be realized with the method aspects of the invention in that after the start of casting there is controlled the casting jet emanating from the bottom discharge and, if necessary, corrected to the desired formation of the casting jet, and thereafter the pouring tube is brought through the casting jet into the casting position.

With the use of the inventive method there is first of all present the advantage of undertaking the starting of the casting operation without hinderance by a pouring tube in comparison with the mode of operation devoid of pouring tube and to adjust the casting jet in an operationally reliable manner to the desired casting jet formation. Furthermore, when necessary it is possible for instance to work with a small oxygen burning lance until the desired formation of the casting jet has been reliably adjusted. Directly thereafter there is applied the pouring tube, and thus all of the known advantages of the casting technology with pouring tube can be employed without limitation.

As a further aspect of this method for the purpose of applying the pouring tubes the tundish, after the bottom discharges are opened and the casting jet adjustment has occurred in the desired manner, is raised by means of a lifting device. The tundish lift stroke corresponds to the immersion path of the lower pouring tube end into the continuous casting mold plus a small safety spacing of approximately maximum 10 cm. When the tundish is raised out of the casting height position into the elevational position for introducing or applying the pouring tube then the pouring tube is displaced transverse to the flow direction of the casting jet through the casting jet. After completion of the introduction of the pouring tube the tundish is lowered into the pouring height position, and in so doing the pouring tube immerses as usual a few centimeters into the metallic bath of the mold.

During the continuous casting of billets and bloom shapes there is used in the mold as a general rule lubricating oil. For improving the casting technology, especially for reducing the breakout rate, according to another facet of the invention it is possible after the immersion of the pouring tube to deposit flux powder onto the level of the metallic bath.

In special situations, where it is not necessary to cast with flux powder, the tundish remains in the elevational position for applying the pouring tube or is only slightly lowered. With this mode of operation there is advantageously introduced into the pouring tube and/or into the mold a gaseous protective medium or agent, such as for instance argon, nitrogen, $CO_2$, methane, propane, or similar gases of mixtures thereof.

When using non-regulatable bottom discharges there can be cast with open discharges. However it is within the contemplation of the inventive method to initially close these discharges with suitable means, for instance, asbestos cord and lead plugs or small plates of different metals until there has been attained the strived for filling height in the tundish, and then to open the non-regulatable bottom discharges prior to the application of the pouring tube.

In practice it has been found to be advantageous to introduce into the pouring tube or into the metallic bath of the mold respectively, deoxidizing agents for the metallic melt in wire form, for instance aluminum wire. Primarily in the case of long sequential pours this measure has found to be advantageous because it is thereby possible to extensively prevent the formation of deposits at the bottom discharges or outlets of the tundish.

The attachment of the pouring tube at the tundish can take place with conventional means or with the inventive apparatus. Normally there is avoided an air gap when applying the pouring tube at the tundish. The sealing between the pouring tube and the tundish occurs with the aid of seals known for this purpose, such as for instance, refractory putty or cement, mortar and ceramic fiber material. When employing ceramic fiber materials there are advantageously cut from appropriate mats of this material suitable sealing rings and introduced between the attachment ring of the pouring tube and the counter element at the tundish. The putty or mortar in most cases is then wiped or spread from the outside into the joint following the application of the pouring tube.

A further advantage of the inventive method and the apparatus for the performance thereof resides in the fact that there can be used conventional pouring tubes. The commercially available pouring tubes possess at their upper end a simple flange for attachment purposes thereof and which flange consists of the same refractory material as the pouring tube. In practical operation it has been found to be particularly advantageous to recess this attachment flange at the pouring tubes by an amount somewhat greater than the diameter of the casting jet. The thus resulting gap in the attachment collar or flange of the pouring tube is pushed through the casting jet upon application of the pouring tube. Surprisingly this recess in the attachment flange has not resulted in the formation of fissures of the pouring tube when exposed to the temperature shock upon application thereof. With this recess in the attachment flange the spraying of the steel melt upon passage of the pouring tube through the casting jet is reduced to such an extent that in practice it is no longer disturbing. On the other hand, if the attachment collar of the pouring tube is not provided with the described gap, then the forming steel spray upon application of the pouring tube constitutes a danger for the casting personnel and a pronounced disturbance for the surroundings. As an advantage of the invention such was always then realized with the construction of the recess in the attachment flange of the pouring tube when the pouring tube wall surface intersecting the casting jet upon introduction of the pouring tube is smaller than the floor discharge cross-section.

The apparatus for carrying out the method is manifested by the features that to both sides of a bottom outlet or discharge at the tundish there is mounted guide rails at least open at one side or end, these guide rails serving for the support elements of the pouring tube and that such guide rails hold the pouring tube in casting position.

The guide rails taper slightly conically towards one another, and specifically at the insertion location for the pouring tube they are further apart than at the bottom outlet or discharge. Due to this arrangement there is achieved the result that the pouring tube with its support element can be simply introduced into the guide rails and without any special auxiliary means can be manually displaced into the casting position. In order that the pouring tube is positively fixed in the casting position there can be provided appropriate stops or ramp wedges or the like, which additionally have the advantage of pressing the pouring tube against the tundish and thus preventing the formation of a gap. Furthermore, the pouring tube can be pressed against the tundish also by means of suitable springs which act either directly or through the agency of a suitable lever at the holding flange of the pouring tube.

The contact plate for the holding flange of the pouring tube at the tundish forms an appropriate flat plate, for instance a flange, which is provided with a throughpassage hole having a larger diameter than the bottom discharge opening. This contact or press-on flange for the pouring tube in practice is oftentimes formed by the holding flange for the bottom discharge nozzle.

The inner diameter at the inlet side of the pouring tube is at least equal to or somewhat greater than the diameter of the throughpassage hole in the contact plate and the contact flange at the tundish. Due to the correct selection of the inner diameter of the pouring tube there is particularly to be avoided a wetting of the pouring tube wall by the casting jet. For instance, the casting jet should not run down along the inner wall of the pouring tube.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
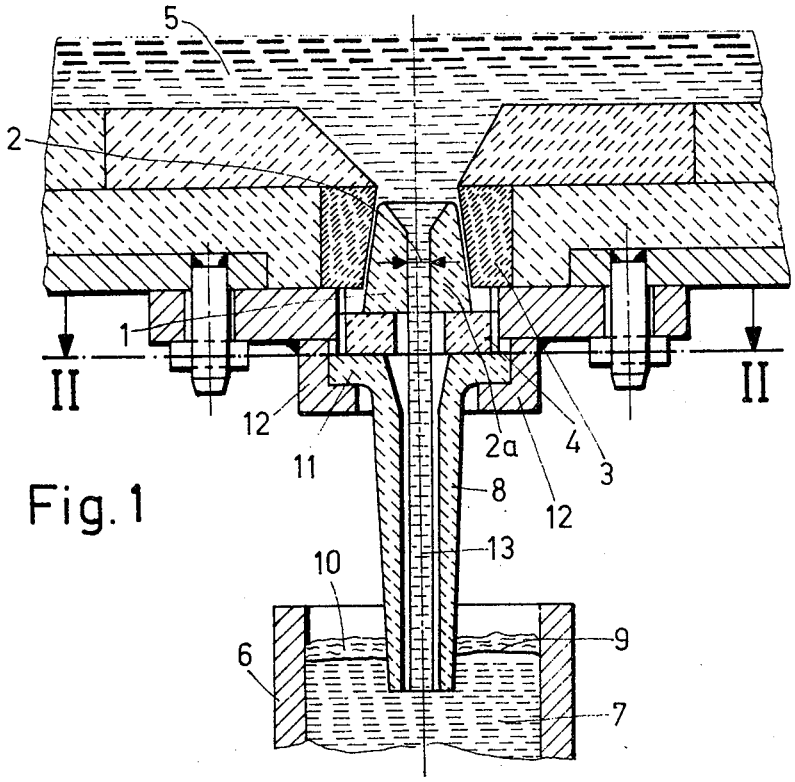
FIG. 1 is a vertical section through a pouring tube attached to a tundish and which immerses into the melt of the mold.

Referring now to the drawings, the tundish illustrated in FIG. 1 possesses a non-regulatable bottom discharge or outlet 1, for instance in the form of a pouring nozzle 1. This bottom outlet 1 has a defined cross-section 2 with a very wear-resistant inner surface. The pouring nozzle 1 is inserted in a nozzle block 3 and held by the retaining or holding flange 4. This holding flange 4 serves at the same time as the sealing surface for the attachment or fastening flange 11 defining support means of a pouring tube 8. The steel flows from the tundish 5 through the nozzle channel 2a into the continuous casting mold 6. The pouring tube 8 immerses into the metallic bath 7 on the continuous casting mold 6. The flux powder 10 is located on the metal bath level 9 in the casting mold. The pouring tube 8 may be provided with a bore or passageway 17 for the introduction of a suitable gaseous protective agent. Also as previously explained, sealing means 18, such as formed of refractory putty, mortar, or a ceramic fiber material, may be provided between the pouring tube 8 and the tundish 5.

Figure 2:
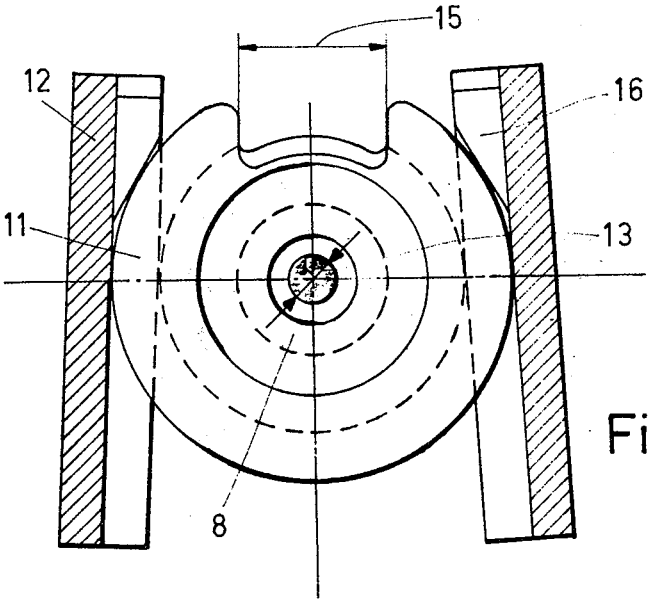
FIG. 2 is a sectional view through the attachment flange of a pouring tube taken along the section line II—II of FIG. 1.
Figure 1:
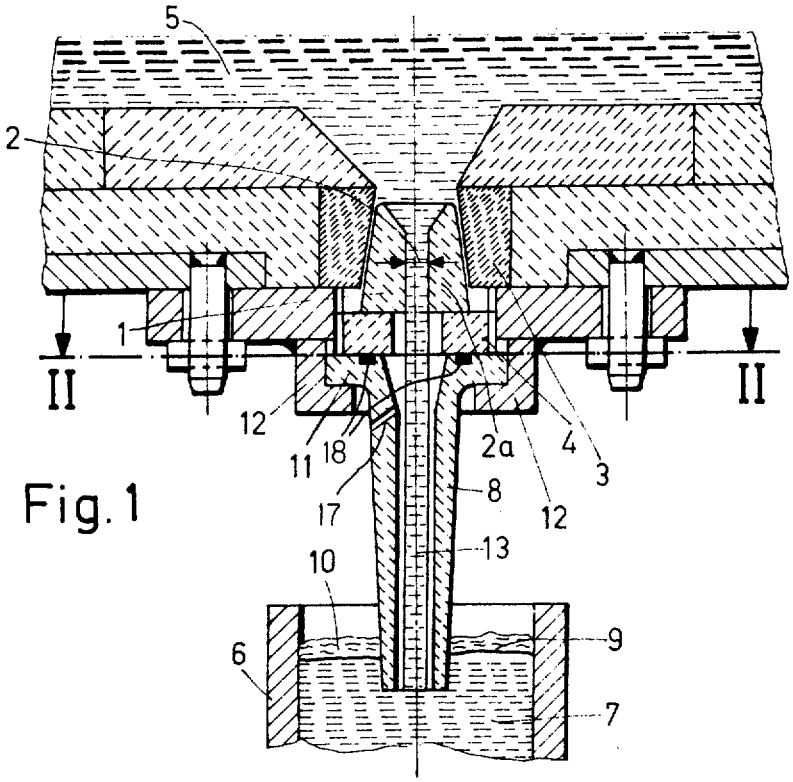
Figure 2:
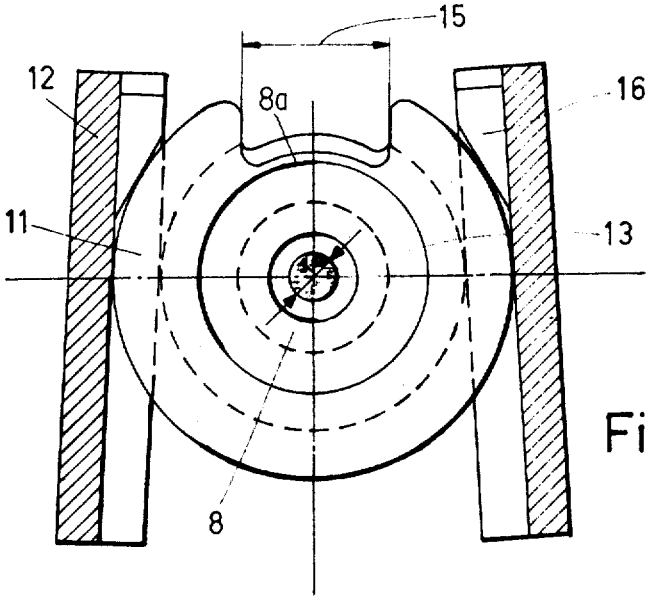

The attachment flange 11 of the pouring tube 8 possesses the gap or recess 15 shown in FIG. 2. This gap is about 40 millimeters wide and corresponds with the casting jet diameter 13 of about 15 millimeters. The pouring tube 8 is retained in the casting position by means of its holding collar or attachment flange 11 through the agency of the guide rails 12 at the tundish 5. The fixation of the pouring tube 8 in the casting position with this exemplary embodiment takes place by means of two ramp wedges 16 which simultaneously form a stop for the pouring tube. The pouring tube 8 includes a wall portion 8*a* (FIG. 2) which intersects the casting jet as the pouring tube is mounted by pushing the same in along the rails 12 and such wall surface is smaller than the bottom outlet cross-section.

It is also within the contemplation of the invention, from case to case, especially in the case of longer sequential pours, to carry out an exchange of the pouring tube 8. Hence the pouring tube 8 is displaced in the opposite direction from that during its insertion out of the guide rails 12 manually or with simple mechanical aids or auxiliary means, and the insertion of a new pouring tube occurs in the described manner.

The casting operation at the continuous casting installation is initiated in that a transport ladle with steel, for instance in this example a 30 ton ladle, is brought by a crane over the tundish. The steel is produced in a bottom blowing oxygen converter and has approximately the following composition: C = 0.07%, Si = 0.20%, Mn = 0.10%, P = < 0.05%, S = < 0.05%, Al = < 0.01%. Its tapping temperature amounts to about 1660°C. After a transport time of about 15 minutes the steel emanates from the ladle with a temperature of about 1590°C and is deposited in the tundish. The point in time at which the ladle is opened and the first batch of steel flows into the tundish is defined as the start of casting.

The three bottom nozzles 1 in the tundish at this point in time are closed by a lead plug and an asbestos cord. After about 2 minutes there is attained in the tundish a filling height of about 35 centimeters, corresponding to a melt weight of about 4 tons. As soon as this degree of filling has been reached in the tundish then the asbestos cords are removed from the nozzles, and normally the steel flows without further manipulation with the desired casting jet formation 13 into the continuous casting mold 6. In the event that the desired formation of the casting jet has not been attained or no steel flows out of the bottom discharge nozzle, following removal of the asbestos stopper, then for a short period of time there is burned in the bottom nozzle with a small oxygen burning device or lance. The oxygen lance has a diameter of about 5 millimeters. As soon as the steel flows with the desired casting jet formation oxygen is then no longer used.

During this time the tundish is located in the casting elevational position. As soon as the three casting jets flow in an operationally reliable manner in the desired way — normally this condition is reached approximately 3 minutes following the start of casting — then the tundish is raised to the elevational position for the application or mounting of the pouring tube, by means of the hydraulic mechanical tundish-lift mechanism. The lower edge of the tundish in this position is located approximately 520 millimeters over the upper edge of the covering of the mold. Then for each strand there is introduced the pouring tube 8 into the guide rails 12 and brought into the casting position through the casting jet. The entire operation for the three pouring tubes amounts to about 1 minute.

Directly thereafter the tundish is returned back into the casting elevational position. The pouring tube then immerses about 7 centimeters into the metallic bath of the mold. Thereafter upon each bath level of the mold there is applied a flux powder layer of about 2 centimeters. The consumption of flux powder on the average is in the order of about 0.7 kg/t of steel.

The entire casting time for the 30 ton steel melt of the indicated composition amounts to about 42 minutes with a casting speed of about 2 meters per minute and an ingot format of 142 millimeters square.

As soon as the content of a steel transport ladle (30 tons) has been poured there continuously follows the pour of the next 30 ton melt. Normally, there are undertaken in this manner sequential pours of 3 to 10 ladles before the tundish is completely emptied.

While there is shown and described present preferred embodiments of the invention, it is to be distinctly understood that the invention is not limited thereto but may be otherwise variously embodied and practiced within the scope of the following claims. Accordingly,

What is claimed is:

1. A method of pouring metal into a continuous casting mold, comprising the steps of: casting metal from a ladle into a tundish having at least one non-regulatable bottom outlet and then into at least one mold by means of a pouring tube, after the start of casting controlling the casting jet emanating from the bottom outlet, and when necessary correcting the formation of the casting jet to a desired casting jet formation, and thereafter bringing the pouring tube through the casting jet into the casting position.

2. The method as defined in claim 1, including the step of securing the pouring tube at the tundish and after bringing the same into the casting position immersing the pouring tube into the metallic bath of the mold.

3. The method as defined in claim 2, wherein upon termination of the controlling step and then necessary the correction of the casting jet raising the tundish out of a casting elevational position into an elevational position for mounting the pouring tube, and after mounting of the pouring tube again lowering the tundish to the casting elevational position.

4. The method as defined in claim 3, including the step of opening a closed non-regulatable bottom outlet prior to the mounting of the pouring tube.

5. The method as defined in claim 1, including the step of bringing the pouring tube into the casting position in a direction transverse to the flow direction of the casting jet.

6. The method as defined in claim 2, wherein following immersion of the pouring tube in the metallic bath there is applied flux powder to the surface of the metallic bath.

7. The method as defined in claim 1, including the step of introducing into the pouring tube a gaseous protective agent.

8. The method as defined in claim 1, including the step of introducing into the mold a gaseous protective agent.

9. An apparatus for casting metal into a continuous casting mold, comprising a tundish equipped with at least one non-regulatable bottom outlet, at least one pouring tube extending up to the region of the mold, said bottom outlet cooperating with said pouring tube, and wherein to each side of the bottom outlet there is mounted at the tundish guide rails for support means of the pouring tube, said guide rails being open at least at one end, the guide rails possessing an introduction location for the pouring tube, said guide rails slightly conically running together from the introduction location for the pouring tube to the bottom outlet.

10. An apparatus for casting metal into a continuous casting mold, comprising a tundish equipped with at least one non-regulatable bottom outlet, at least one pouring tube extending up to the region of the mold, said bottom outlet cooperating with said pouring tube, and wherein to each side of the bottom outlet there is mounted at the tundish guide rails for support means of the pouring tube, said guide rails being open at least at one end, and wherein said support means for a pouring tube is provided with a recess at the side at which it is displaced through the casting jet, and this recess is somewhat wider than the diameter of the casting jet.

11. The apparatus as defined in claim 10, wherein the bottom outlet possesses a nozzle which, viewed in the casting direction, is arranged following a plate having a throughpassage hole, the throughpassage hole of said plate possessing a greater diameter than that of the nozzle.

12. The apparatus as defined in claim 11, wherein the inner diameter of an inlet side of the pouring tube is at least equal to the diameter of the throughpassage hole of the plate.

13. The apparatus as defined in claim 11, wherein the inner diameter at an inlet side of the pouring tube is greater than the diameter of the throughpassage hole of the plate.

14. An apparatus for casting metal into a continuous casting mold, comprising a tundish equipped with at least one non-regulatable bottom outlet, at least one pouring tube extending up to the region of the mold, said bottom outlet cooperating with said pouring tube, and wherein to each side of the bottom outlet there is mounted at the tundish guide rails for support means of the pouring tube, said guide rails being open at least at one end, the pouring tube having support means with a wall surface that intersects the casting jet upon mounting of the pouring tube and in which the wall thickness is smaller than the bottom outlet cross-section.

* * * * *

UNITED STATES PATENT OFFICE

CERTIFICATE OF CORRECTION

PATENT NO. : 3,982,582

DATED : September 28, 1976

INVENTOR(S) : Eberhard Knorr and Thomas Ludwig Grünwald

It is certified that error appears in the above-identified patent and that said Letters Patent are hereby corrected as shown below:

Column 1, line 10, delete "one-regulatable" and insert --one non-regulatable--.

Column 1, line 14, delete "salts" and insert --melts--.

Column 1, line 17, delete "pouring" and insert --pour--.

Column 1, line 64, delete "discharge" and insert --discharges--.

Column 2, line 42, delete "rigid" and insert --rapid--.

Column 3, line 28, delete "of mixtures" and insert --or mixtures--.

Column 5, line 25, after "bath 7" delete "on" and insert --of--.

Column 7, line 7, delete "then" and insert --when--.

Figures 1 and 2 should read as shown on the attached sheet.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,982,582

DATED : September 28, 1976

INVENTOR(S) : Eberhard KNORR, Thomas Ludwig GRÜNWALD & Arno OSWALD

It is certified that error appears in the above-identified patent and that said Letters Patent are hereby corrected as shown below:

Page 1, left-hand column, in paragraph [73]
read "Concast AG, Zurich, Switzerland" as
--Eisenwerk-Gesellschaft Maximilianshütte mbH Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*